US012048332B2

(12) United States Patent
Hu

(10) Patent No.: US 12,048,332 B2
(45) Date of Patent: Jul. 30, 2024

(54) TOBACCO EVAPORATOR AND HEATING CONTROL METHOD

(71) Applicant: SHENZHEN JIANAN TECHNOLOGY CO., LIMITED, Guangdong (CN)

(72) Inventor: Weihua Hu, Guangdong (CN)

(73) Assignee: SHENZHEN JIANAN TECHNOLOGY CO., LIMITED, Shenzhen (CN)

( * ) Notice: Subject to any disclaimer, the term of this patent is extended or adjusted under 35 U.S.C. 154(b) by 493 days.

(21) Appl. No.: 17/611,229

(22) PCT Filed: May 15, 2019

(86) PCT No.: PCT/CN2019/086967
§ 371 (c)(1),
(2) Date: Nov. 15, 2021

(87) PCT Pub. No.: WO2020/227951
PCT Pub. Date: Nov. 19, 2020

(65) Prior Publication Data

US 2022/0225687 A1 Jul. 21, 2022

(51) Int. Cl.
*A24F 40/85* (2020.01)
*A24F 40/20* (2020.01)
(Continued)

(52) U.S. Cl.
CPC ..... *A24F 40/85* (2020.01); *A24F 40/20* (2020.01); *A24F 40/42* (2020.01); *A24F 40/46* (2020.01)

(58) Field of Classification Search
CPC ..... A24F 40/85; A24F 40/60; A24F 40/46; A24F 40/40; A24F 40/42; A24F 40/20
See application file for complete search history.

(56) References Cited

U.S. PATENT DOCUMENTS 5,878,752 A * 3/1999 Adams ..... A24F 40/465 131/194
6,188,042 B1 * 2/2001 Sheen ..... B60N 3/14 219/268

(Continued)

FOREIGN PATENT DOCUMENTS

CN 205547353 U 9/2016
CN 208581844 U 3/2019

OTHER PUBLICATIONS

International Search Report of PCT Patent Application No. PCT/CN2019/086967 issued on Feb. 17, 2020.

*Primary Examiner* — Harshad C Patel

(57) ABSTRACT

A tobacco evaporator, comprising a body, a smoke circulation channel, and a heating core assembly. The heating core assembly comprises a smoke bowl assembly and a preheating assembly; the smoke bowl assembly comprises a first bowl body and a second bowl body, and the first bowl body is used for accommodating a substance to be evaporated; the second bowl body is used for accommodating the preheating assembly and is elastically fastened to the preheating assembly, and the preheating assembly is used for when cleaning is needed, being detachably taken out of the second bowl body to clean the smoke circulation channel and pushing the preheating assembly into the fastening position in a set direction after cleaning is completed. A hot air heating mode for a material to be evaporated and a more convenient and thorough air channel cleaning structure are implemented.

12 Claims, 9 Drawing Sheets

(51) Int. Cl.
*A24F 40/42* (2020.01)
*A24F 40/46* (2020.01)

(56) References Cited

U.S. PATENT DOCUMENTS

| | | | | |
|---|---|---|---|---|
| 10,165,797 | B2 * | 1/2019 | Chen | A24F 40/46 |
| 10,512,282 | B2 * | 12/2019 | Bowen | A24F 40/53 |
| 11,020,544 | B2 * | 6/2021 | Ding | A24F 40/46 |
| 11,140,916 | B2 * | 10/2021 | Zuber | A24D 3/10 |
| 11,957,833 | B2 * | 4/2024 | Moloney | A24F 40/65 |
| 2012/0234821 | A1 * | 9/2012 | Shimizu | A24F 40/50<br>219/227 |
| 2015/0366265 | A1 * | 12/2015 | Lansing | A24D 3/17<br>131/329 |

* cited by examiner

TOBACCO EVAPORATOR AND HEATING CONTROL METHOD

TECHNICAL FIELD

The present application relates to the technical field of electronic smoking devices, in particular to a tobacco evaporator and a heating control method.

BACKGROUND

At present, there are three ways for tobacco evaporators to heat the substances to be evaporated (such as cut tobacco, cigarette rolls, etc.): the first way is that the smoke bowl adopts thermal conductive materials, wraps a layer of metal heating sheet around the outer wall of the smoke bowl, and transmits the heat to the cut tobacco in the smoke bowl through conduction, so as to achieve the purpose of evaporating the effective components of cut tobacco; the second way is that the smoke bowl is made of ceramic material, a layer of conductive film is printed on the inner or inner wall of the ceramic bowl, and the heat generated after power on is transmitted to cut tobacco through ceramics; the third method belongs to air heating technology, which uses hot air to heat cut tobacco, and the air flow will evenly pass through the cut tobacco in the whole smoke bowl.

Among them, the advantage of the second method over the external electric heating film method (i.e. the first method) is that the external electric heating film method is generally made of aluminum or stainless steel to ensure the efficiency of heat conduction; at the same time, because the metal has conductivity, it is generally necessary to wrap a layer of insulating material with high temperature resistance on the metal bowl when wrapping the electric heating film; in this way, although insulation is realized, the efficiency of heat conduction is also weakened. The first method also has the problem of affecting the consistency of product heating speed due to the difference of wrapping tightness of electrothermal film. However, both the first method and the second method adopt the direct heat conduction method. There is a problem of uneven heating in baking cut tobacco, and the baked smoke tastes irritating. For this, the smoke baked by the third method has a soft taste and uniform baking, which is enough to overcome the above defects. Although the problems of taste and uniformity have been improved, the cleaning problem after users use is still a big problem to improve the product experience. Therefore, how to clean the tobacco evaporator used by users has become an urgent problem to be solved in the tobacco industry.

SUMMARY

By providing a tobacco evaporator, the application solves the technical problem of difficult cleaning of the used tobacco evaporator in the prior art, and realizes the technical effect of convenient and fast cleaning of the tobacco evaporator, keeping the air flow channel clean and the flue gas clean.

The embodiment of the present application provides a tobacco evaporator, comprising a body, a smoke circulation channel vertically communicated along the body, and a heating core assembly disposed on the path of the smoke circulation channel, wherein, the heating core assembly comprises a smoke bowl assembly and a preheating assembly connected to the smoke bowl assembly; the smoke bowl assembly comprises a first bowl body and a second bowl body, and the first bowl body and the second bowl body are of an up-down structure or an inner and outer sleeving structure; the second bowl body is elastically fastened to the preheating assembly, and the preheating assembly is used for when cleaning is needed, being detachably taken out of the second bowl body to clean the smoke circulation channel and pushing the preheating assembly into the fastening position in a set direction after cleaning is completed.

Preferably, the first bowl body is used for accommodating a substance to be evaporated, the second bowl body is used for accommodating the preheating assembly; the heating core assembly further comprises a clamping portion transversely arranged in the second bowl body, the preheating assembly is elastically fastened to the second bowl body through the clamping portion.

Preferably, the tobacco evaporator further comprises a suction nozzle arranged at one end of the body and a vent pipe arranged at another end of the body, the first bowl body and the second bowl body are in an integrated structure; the second bowl body extends with a reduced diameter in a direction away from the first bowl body and abuts against the vent pipe, the clamping portion is transversely arranged in the second bowl body, penetrates the preheating assembly, and abuts against the second bowl body to make the preheating assembly elastically fastened to the second bowl body; when cleaning is needed, the preheating assembly is detachably taken out of the second bowl body and is pushed into the fastening position after cleaning is completed.

Preferably, both ends of the clamping portion are provided with elastically stretchable bosses, the preheating assembly is provided with two first openings near an inner diameter of the second bowl body with an abrupt change, the second bowl body is provided with two first grooves at a position corresponding to the two first openings; the elastically stretchable bosses on both ends of the clamping portion penetrate the first opening, and is inserted into the second bowl body, and abuts against a side wall of the first groove to make the preheating assembly elastically fastened to the second bowl body.

Preferably, the tobacco evaporator further comprises a suction nozzle arranged on one end of the body, a vent pipe and a support tube arranged on the other end of the body, the first bowl body an d the second bowl body are in an integrated structure; the second bowl body extends with a reduced diameter in a direction away from the first bowl body; one end of the support tube abuts against the body, the other end of the support tube extends to the second bowl body and abuts against a bottom of the second bowl body; one end of the vent pipe abuts against the body, the other end of the vent pipe extends to the preheating assembly and is fixedly connected with a bottom of the preheating assembly; the clamping portion is transversely arranged in the second bowl body, penetrates the preheating assembly, and abuts against the second bowl body to make the preheating assembly elastically fastened to the second bowl body; when cleaning is needed, the preheating assembly is taken out of the second bowl body and is pushed into the fastening position after cleaning is completed.

Preferably, both ends of the clamping portion are provided with elastically stretchable bosses, the preheating assembly is provided with two second openings near an inner diameter of the second bowl body with an abrupt change, the second bowl body is provided with two second grooves at a position corresponding to the two second openings; the elastically stretchable bosses on both ends of the clamping portion penetrate the second opening, and is inserted into the second bowl body, and abuts against a side wall of the second groove to make the preheating assembly elastically fastened to the second bowl body.

Preferably, the tobacco evaporator further comprises a suction nozzle arranged at one end of the body and a vent pipe arranged at another end of the body, the second bowl body is sleeved on an outer periphery of the first bowl body; the first bowl body is elastically fastened with the second bowl body, the first bowl body is used for accommodating a substance to be evaporated and the preheating assembly; the heating core assembly comprises a clamping portion transversely arranged in the second bowl body, the preheating assembly is elastically fastened with second bowl body through the clamping portion; the clamping portion penetrates and accommodates the preheating assembly and the first bowl body, and abuts against the second bowl body; when cleaning is needed, the preheating assembly is taken out of the second bowl body and is pushed into the fastening position after cleaning is completed.

Preferably, both ends of the clamping portion are provided with elastically stretchable bosses, the first bowl body is provided with two fifth openings, the second bowl body is provided with two third grooves at a position corresponding to the two fifth openings; the elastically stretchable bosses on both ends of the clamping portion penetrate the fifth opening, and is inserted into a side wall of the second bowl body, and abuts against a side wall of the third groove to make the preheating assembly elastically fastened to the second bowl body.

Preferably, the tobacco evaporator further comprises a flip cover rotatably connected to the body, a rotating shaft is arranged on a bottom of the body, and one end of the flip cover is provided with a hole matched with a clearance of the rotating shaft, so that the flip cover can be turned along the rotating shaft.

Preferably, the preheating assembly comprises a preheating assembly housing, thermal conductive materials placed inside the preheating assembly housing and a heating element sleeved outside the second bowl body, an outer wall of the preheating assembly housing is contacted with an inner wall of the second bowl body; the heating element contacted with an outer wall of the second bowl body is used for heating the thermal conductive materials.

Preferably, the preheating assembly comprises a preheating assembly housing, a spiral part placed under the preheating assembly housing and abutted against the preheating assembly housing, and a heating element sleeved outside the second bowl body; an outer wall of the spiral part is contacted with an inner wall of the second bowl body; the heating element contacted with an outer wall of the second bowl body is used for heating cold air; the outer wall of the spiral part and the inner wall of the second bowl body form a spiral preheating channel through which the cold air passes to realize the uniform heating of the cold air.

Preferably, the tobacco evaporator further comprises a heat insulation for insulating the preheating assembly when the heating element generates heat, the heat insulation comprises an insulation ring sleeved at an upper end of the first bowl body, an insulation sleeve arranged outside the second bowl body and a sealing silica gel connecting the insulation ring and the insulation sleeve; one end of the insulation sleeve is connected with the sealing silica gel, the other end of the insulation sleeve is bent to the vent pipe; the heat insulation forms a closed thermal insulation space with the smoke bowl assembly and the vent pipe, and the thermal insulation space is filled with thermal insulation materials to insulate the tobacco evaporator.

On the other hand, the present application provides A tobacco heating control method, wherein, comprises the following steps:

S1. a preheating assembly arranged inside a second bowl body and elastically fastened to the second bowl body heating cold air coming into the second bowl body;

S2. the heated cold air entering a first bowl body, heating the substance to be evaporated placed in the first bowl body, and evaporating effective components in the substance to be evaporated;

S3. when cleaning is needed, the preheating assembly is taken out of the second bowl body and is pushed into a fastening position after cleaning is completed.

One or more technical solutions provided in the embodiment of the application have at least the following technical effects or advantages: by designing the air preheating assembly as a detachable component, the user can disassemble the preheating assembly for cleaning; after the preheating assembly is removed from the body, the whole air passage forms a hollow passage through the front and back, without cleaning dead corner, which is convenient for cleaning; at the same time, as a detachable part, the preheating assembly can be replaced with a new one when it is used for a long time, so as to keep the air flow channel clean and the flue gas clean.

DESCRIPTION OF THE DRAWINGS

In order to more clearly explain the embodiment of the application or the technical scheme in the prior art, the following will briefly introduce the attached drawings needed to be used in the embodiment or the description of the prior art. It is obvious that the attached drawings in the following description are only the embodiment of the application. For those skilled in the art, without paying creative labor, other drawings can also be obtained from the provided drawings.

DETAILED DESCRIPTION OF THE PREFERRED EMBODIMENT

By providing a tobacco evaporator, the embodiment of the application solves the technical problems existing in the prior art, such as the difficulty of cleaning the tobacco evaporator after use. By designing the air preheating assembly into a detachable component, the user can disassemble the preheating assembly for cleaning. After the preheating assembly is removed from the machine body, the whole air channel forms a hollow channel through the front and back, At the same time, as a detachable part, the preheating assembly can be replaced with a new preheating assembly when it is used for a long time, so as to keep the smoke flow channel clean and the smoke clean.

In order to better understand the above technical scheme, the above technical scheme will be described in detail below in combination with the drawings of the description and specific embodiments. It should be understood that the embodiments of the application and the specific features in the embodiments are a detailed description of the technical scheme of the application, rather than a limitation of the technical scheme of the application. Without conflict, the embodiments of the present application and the technical features in the embodiments may be combined with each other.

The First Embodiment

Figure 1:
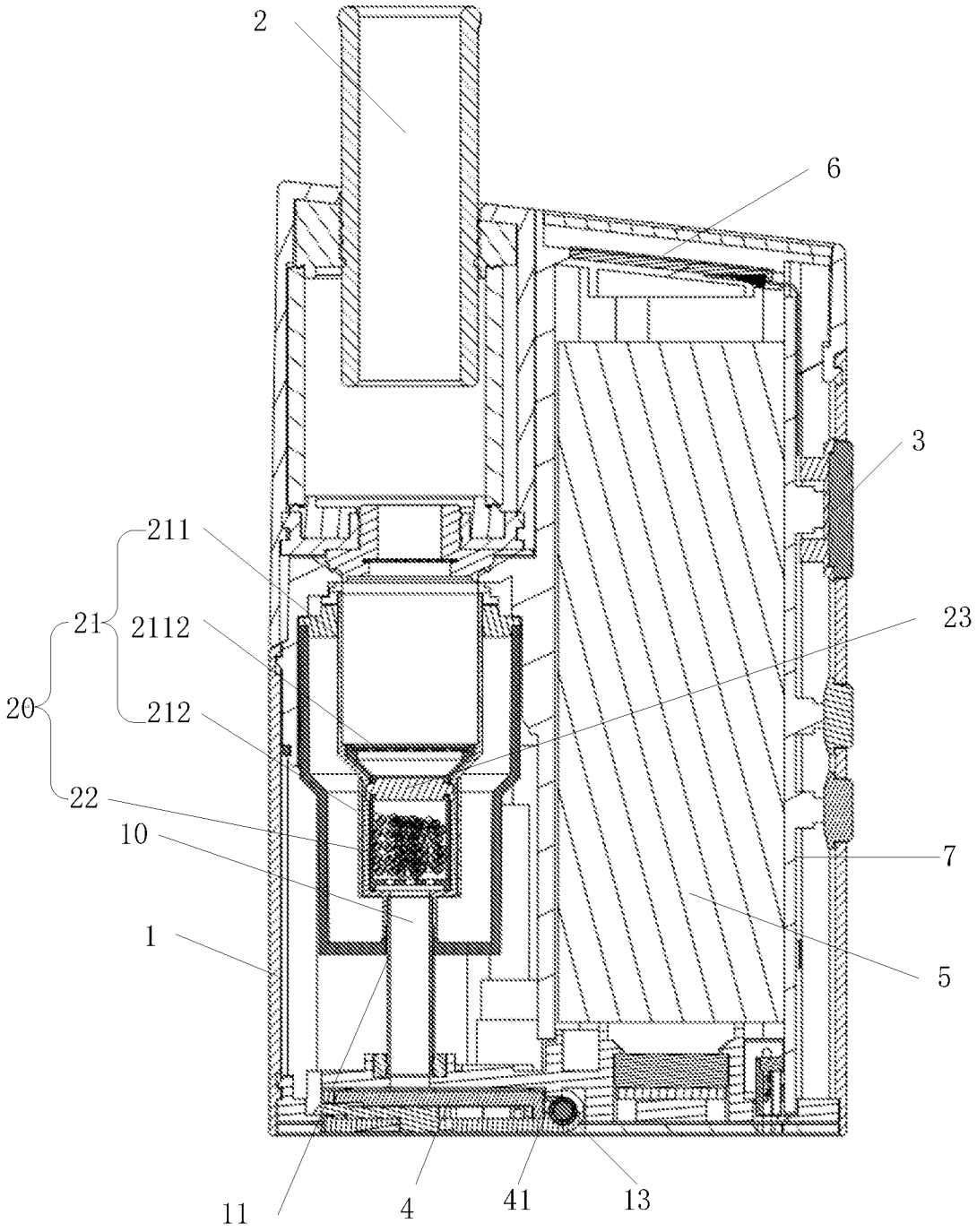
FIG. 1 is a cross-sectional view of a tobacco evaporator provided in the first embodiment of the present application.

As shown in FIG. 1, the embodiment of the present application provides a tobacco evaporator, comprising a body 1, a smoke circulation channel 10 vertically communicated along the body 1, and a heating core assembly 20 disposed on the path of the smoke circulation channel 10. The heating core assembly 20 comprises a smoke bowl assembly 21, and a preheating assembly 22 connected to the smoke bowl assembly 21. The smoke bowl assembly 21 comprises a first bowl body 211 and a second bowl body 212, and the first bowl body 211 and the second bowl body 212 are of an up-down structure. The first bowl body 211 and the second bowl body 212 are in an integrated structure, the first bowl body 211 is used for accommodating a substance to be evaporated, the second bowl body 212 is used for accommodating the preheating assembly 22. The second bowl body 212 is elastically fastened to the preheating assembly 22. The substance to be evaporated can be cigarettes, cut tobacco, herbs or volatile drugs. The preheating assembly 22 is used for when cleaning is needed, being detachably taken out of the second bowl body 212 to clean the smoke circulation channel 10 and pushing the preheating assembly 22 into the fastening position in a set direction after cleaning is completed.

The tobacco evaporator further comprises a suction nozzle 2 arranged at one end of the body 1 and a vent pipe 11 arranged at another end of the body 1. The suction nozzle 2 is arranged upper the first bowl body 211 and is used for users to inhale smoke. One end of the vent pipe 11 abuts against the body 1, the other end abuts against the bottom of the second bowl body 212. Cold air enters the tobacco evaporator through vent pipe 11.

As can be seen from FIG. 1: the second bowl body 212 extends with a reduced diameter in a direction away from the first bowl body 211 and abuts against the vent pipe 11. The first bowl body 211 is in a rectangular structure, and the second bowl body 212 includes two parts, one part is in a rectangular structure and the other part connected with the first bowl body 211 is in a trapezoidal structure. The heating core assembly 20 further comprises a clamping portion 23, transversely arranged in the part of the second bowl body 212 which is in a trapezoidal structure. The clamping portion 23 penetrates the preheating assembly 22, and abuts against the second bowl body 212. When cleaning is required, the clamping portion 23 and the preheating assembly 22 are taken out from the second bowl body 212 as a whole. After cleaning, the clamping portion 23 and the preheating assembly 22 are pushed into the fastening position as a whole, and the preheating assembly 22 is elastically fastened to the second bowl body 212 through the clamping portion 23.

In addition, the first bowl body 211 is provided with a mesh filter structure 2112 to prevent the material to be evaporated from falling. The mesh filter structure 2112 is arranged at the connection between the first bowl body 211 and the second bowl body 212, and a plurality of filter holes are distributed on the mesh filter layer structure 2112.

Further, as can be seen from FIG. 1, the tobacco evaporator also includes a flip cover 4, the flip cover 4 is rotatably connected to the body 1 of the tobacco evaporator. A rotating shaft 13 is arranged at the bottom of the body 1, one end of the flip cover 4 is provided with a hole 41 matched with the gap of the rotating shaft 13, and the flip cover 4 can be turned along the rotating shaft 13 by sheathing one end of the hole 41 of the flip cover 4 outside the rotating shaft 13. When it is necessary to clean the tobacco evaporator, rotate the flip cover 4, pull out the suction nozzle 2, and take out the preheating assembly 22 from the second bowl body 212, so that the smoke circulation channel 10 is easy to be cleaned without dead corners. It should be noted that when the flip cover 4 is in the position in FIG. 1, the flip cover 4 can fix the preheating assembly 22.

Further, as can be seen from FIG. 1, the tobacco evaporator in the embodiment of the application also includes a battery 5, which is arranged in the body 1 for supplying power to the tobacco evaporator, and the temperature sensor is fixed on the outer wall of the first bowl body 211 by pasting, welding and other methods for measuring the temperature of the first bowl body 211, that is, measuring the heating temperature of the material to be evaporated and transmitting the temperature signal; a PCB circuit board 7 arranged on the side wall of one end of the battery 5 away from the heating core assembly 20; the controller is arranged on the PCB circuit board 7 and electrically connected with the temperature sensor and the preheating assembly 22 respectively, which is used to receive the induced temperature signal and control the preheating assembly 22 to heat the material to be evaporated according to the preset temperature; in the actual heating process, the controller can adjust the power of the preheating assembly 22 according to the temperature signal transmitted by the temperature sensor, so as to adjust the heating temperature and keep the heating temperature at the set temperature; the switch 3 is arranged on the outer wall of the body 1 and connected with the controller and the battery 5 respectively to control the connection between the controller and the battery 5; when the switch is pressed, the preheating assembly 22 starts heating; the display screen 6 is used to display the status parameters of the tobacco generator, such as the power of the battery 5.

Figure 2:
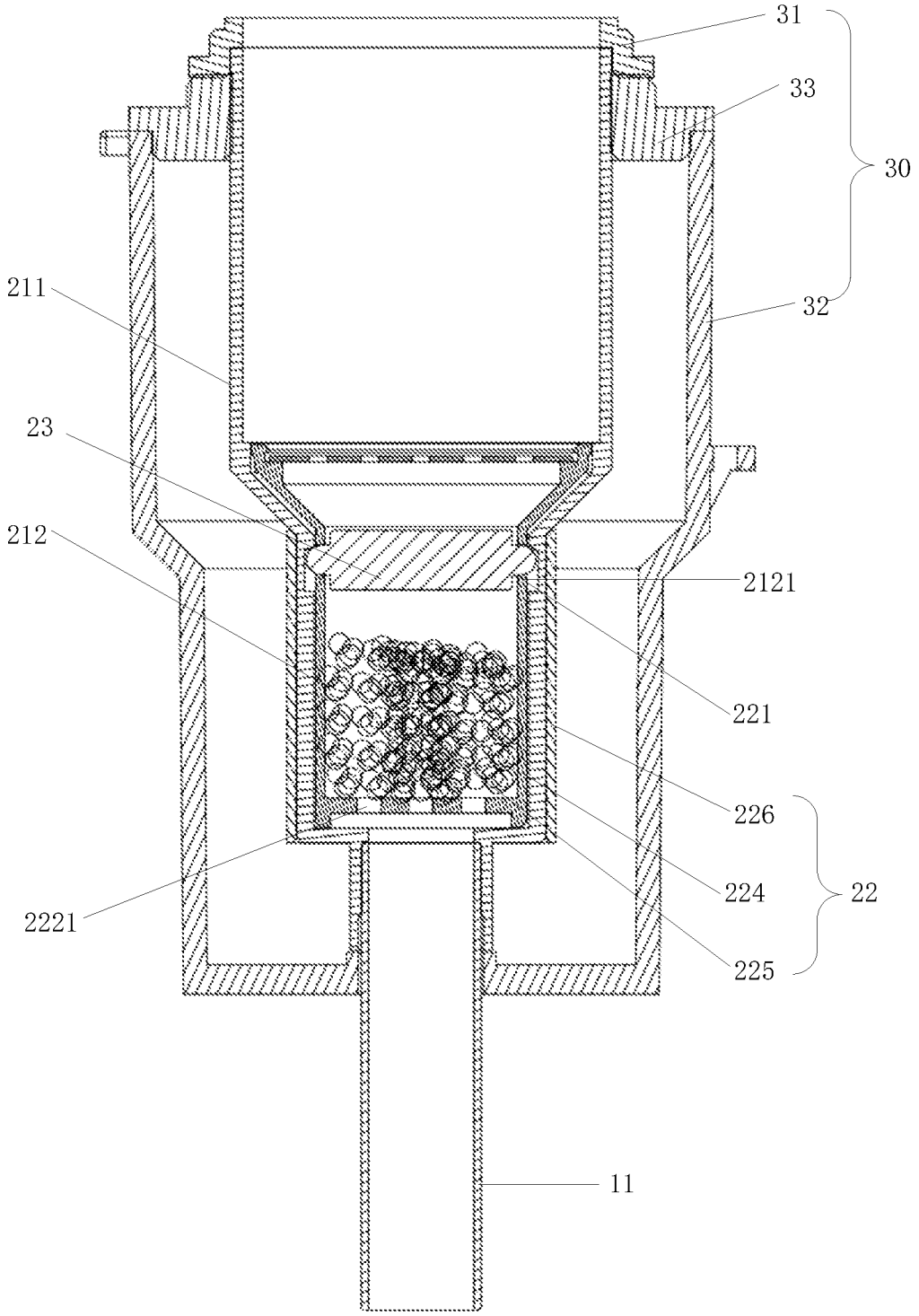
FIG. 2 is a cross-sectional view of a heating core assembly provided in the first embodiment of the present application.

Combined with FIG. 2, both ends of the clamping portion 23 are provided with elastically stretchable bosses, the preheating assembly 22 is provided with two first openings 221 near an inner diameter of the second bowl body 212 with an abrupt change, the second bowl body 212 is provided with two first grooves 2121 at a position corresponding to the two first openings 221; the elastically stretchable bosses on both ends of the clamping portion 23 penetrate the first opening 221, and is inserted into the second bowl body 212, and abuts against a side wall of the first groove 2121 to make the preheating assembly 22 elastically fastened to the second bowl body 212.

When cleaning is required, the elastically stretchable bosses at both ends of the clamping portion 23 contract under the action of external force, the preheating assembly 22 is separated from the second bowl body 212, and the preheating assembly 22 is removed from the second bowl body 212 through the first bowl body 211. After cleaning, push the preheating assembly 22 back into the second bowl body 212, and the elastically stretchable bosses at both ends of the clamping portion 23 move along the side wall of the second bowl body 212. When moving to the first groove 2121, the elastically stretchable bosses at both ends of the clamping portion 23 are inserted into the side wall of the first groove 2121 and butted with the side wall of the first groove 2121 to make the preheating assembly 22 elastically fastened to the second bowl body 212.

Further, it can be seen from FIG. 2: the preheating assembly 22 further comprises a preheating assembly housing 224, thermal conductive materials 225 placed inside the preheating assembly housing 224 and a heating element 226 sleeved outside the second bowl body 212. The outer wall of the preheating assembly housing 224 is contacted with the inner wall of the second bowl body 212, the bottom wall of the preheating assembly housing 224 near one end of the vent pipe 11 is provided with a plurality of vent holes 2221 for cold air entry; the heating element 226 contacted with the outer wall of the second bowl body 212 is used to transfer the heat generated by the heating element 226 to the thermal conductive materials 225 through the second bowl body 212 and the preheating assembly housing 224 to heat the thermal conductive materials 225. The heated thermal conductive materials 225 exchange heat with the cold air entering the preheating assembly 22 to realize that the cold air is heated, wherein the heating element 226 is a heating wire or an electric heating film.

Further, the tobacco evaporator further comprises a heat insulation 30 for insulating the preheating assembly 22 when the heating element 226 generates heat. The heat insulation 30 comprises an insulation ring 31 sleeved at an upper end of the first bowl body 211, an insulation sleeve 32 arranged outside the second bowl body 212, a sealing silica gel 33 connecting the insulation ring 31 and the insulation sleeve 32, and the inner wall of the insulation ring 31 is contacted with the outer wall of the first bowl body 212; the inner wall of the sealing silica gel 33 is contacted with the first bowl body 211, the outer wall is connected with the insulation sleeve 32; the insulation sleeve 32 maintains a certain distance from both the first bowl body 211 and the second bowl body 212; one end of the insulation sleeve 32 is connected with the sealing silica gel 33, the other end of the insulation sleeve 32 is bent to the vent pipe 11. The heat insulation 30 forms a closed thermal insulation space with the smoke bowl assembly 21 and the vent pipe 11, and the thermal insulation space is filled with thermal insulation materials to further insulate the tobacco evaporator and prevent heat loss into the air. As can be seen from FIG. 2, a step groove is set at the connection between the sealing silica gel 33 and the insulation sleeve 32 for positioning the insulation sleeve 32 for easy installation.

The thermal conductive materials 225 is a material with large heat capacity and good heat conductivity, such as metal, which is convenient for better heat conduction. The clamping portion 23 is an elastic part that can produce deformation, and can be other elastomers such as elastic needle or elastic sheet, which can meet the requirements of detachable use.

Figure 3:
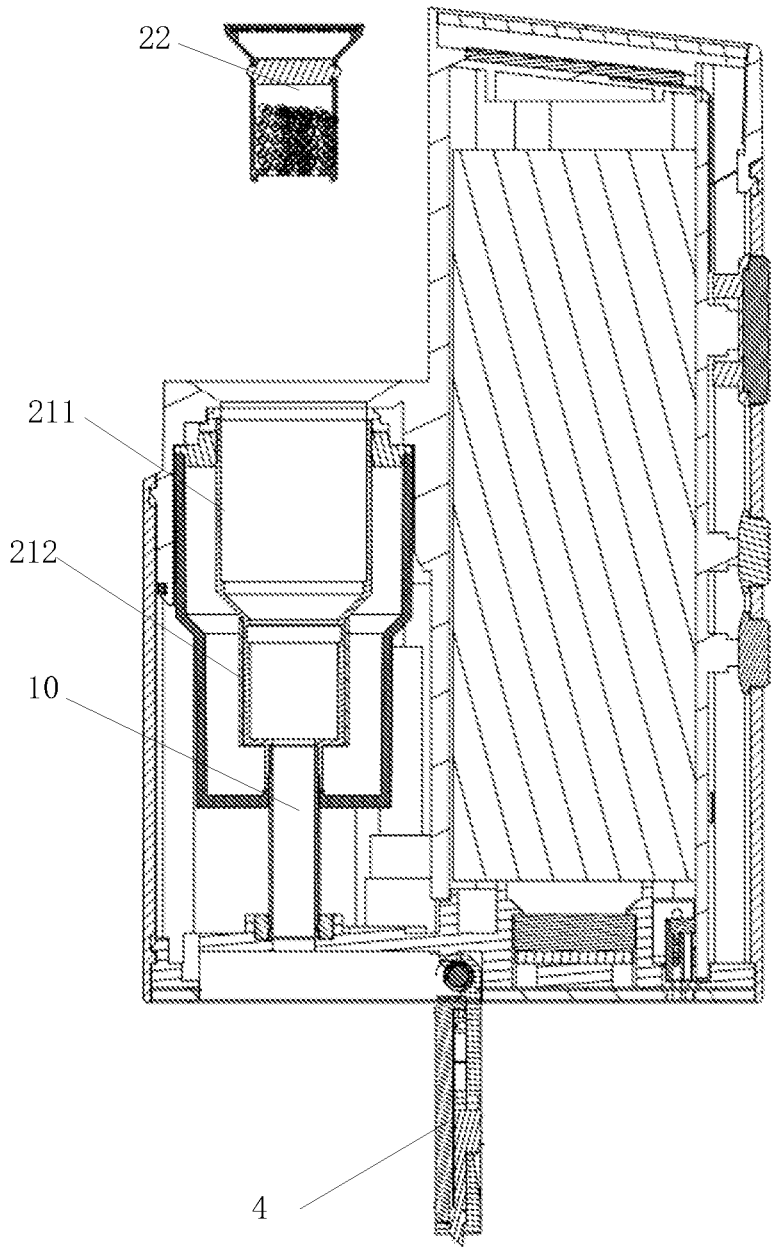
FIG. 3 is a cross-sectional view of the tobacco evaporator provided in the first embodiment of the present application during cleaning.

As shown in FIG. 3, when the tobacco evaporator is cleaned, the preheating assembly 22 will be taken out from the second bowl body 212 through the first bowl body 211 in the direction shown in the figure, and the flip cover 4 will be opened to the position shown in FIG. 3, so that the smoke circulation channel 10 forms a hollow channel without dead corners inside, which is convenient for cleaning.

The Second Embodiment

Figure 4:
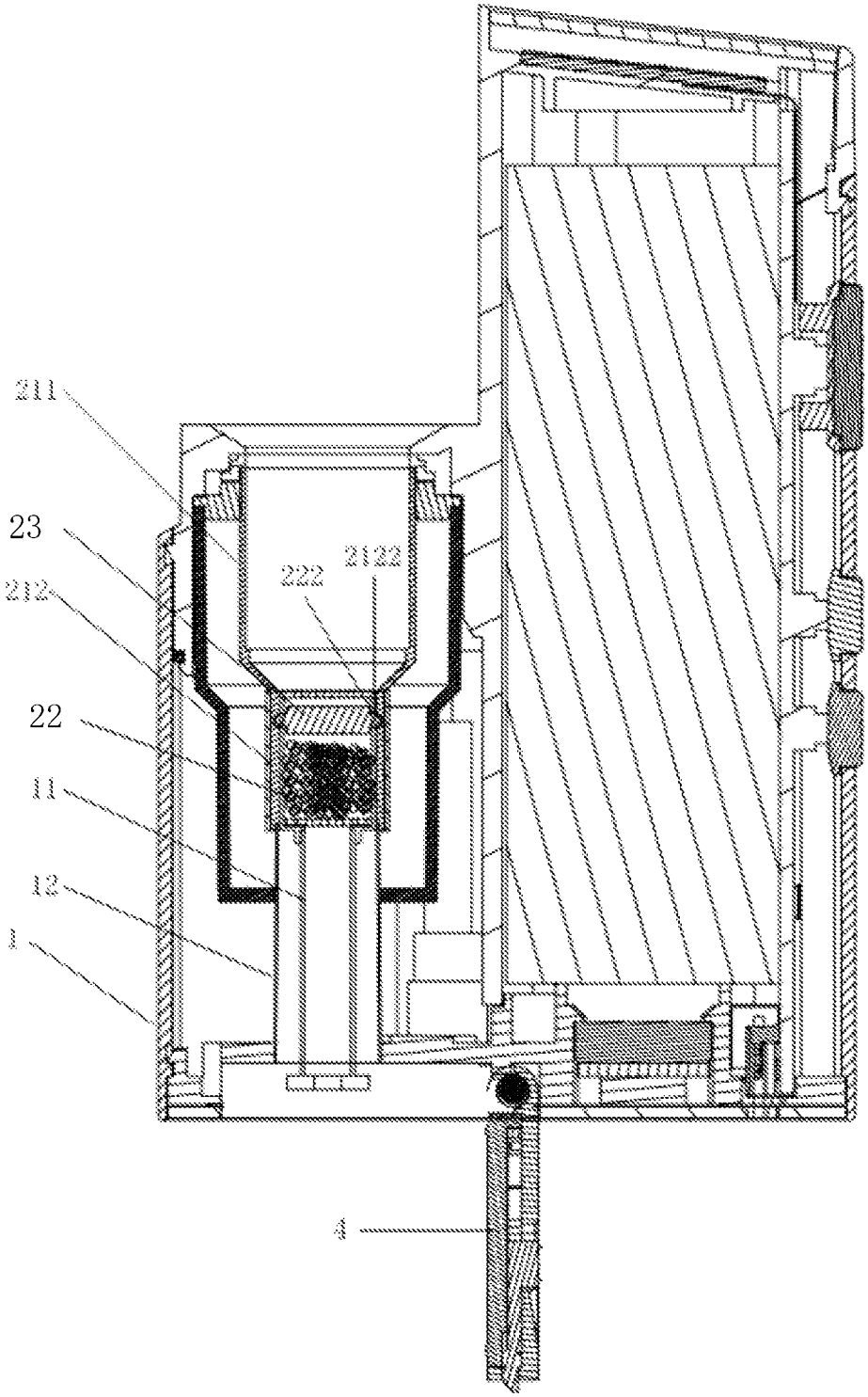
FIG. 4 is a cross-sectional view of a tobacco evaporator provided in the second embodiment of the present application.

As shown in FIG. 4, the difference between the second embodiment and the first embodiment is that the setting position of preheating assembly 22 and the removal direction of preheating assembly 22 during cleaning are different. Specifically, the tobacco evaporator of the second embodiment comprises a support tube 12 for supporting the second bowl body 212. One end of the support tube 12 abuts against the body 1, the other end of the support tube 12 extends to the second bowl body 212 and abuts against a bottom of the second bowl body 212. The second bowl body 212 extends with a reduced diameter in a direction away from the first bowl body 211. One end of the vent pipe 11 abuts against the body 1, the other end of the vent pipe 11 extends to the preheating assembly 22 and is fixedly connected with a bottom of the preheating assembly 22. Preferably, the vent pipe 11 and the bottom of the preheating assembly 22 can be fixedly connected by riveting; during cleaning, the preheating assembly 22 can be taken out from the second bowl body 212 through the setting position of the flip cover 4 by pulling the vent pipe 11, which is convenient for operation.

Further, the clamping portion 23 is transversely arranged in the second bowl body 212, penetrates the preheating assembly 22, and abuts against the second bowl body 212. When cleaning is needed, the preheating assembly 22 is taken out of the second bowl body 212; after cleaning, the clamping portion 23 and the preheating assembly 22 are pushed into a fastening position to make the clamping portion 23 elastically fastened to the second bowl body 212.

As can be seen from FIG. 4: the preheating assembly 22 is provided with two second openings 222 near an inner diameter of the second bowl body 212 with an abrupt change; the second bowl body 212 is provided with two second grooves 2122 at a position corresponding to the two second openings 222; the elastically stretchable bosses on both ends of the clamping portion 23 penetrate the second opening 222, and is inserted into the second bowl body 212, and abuts against a side wall of the second groove 2122 to make the preheating assembly 22 elastically fastened to the second bowl body 212.

Figure 5:
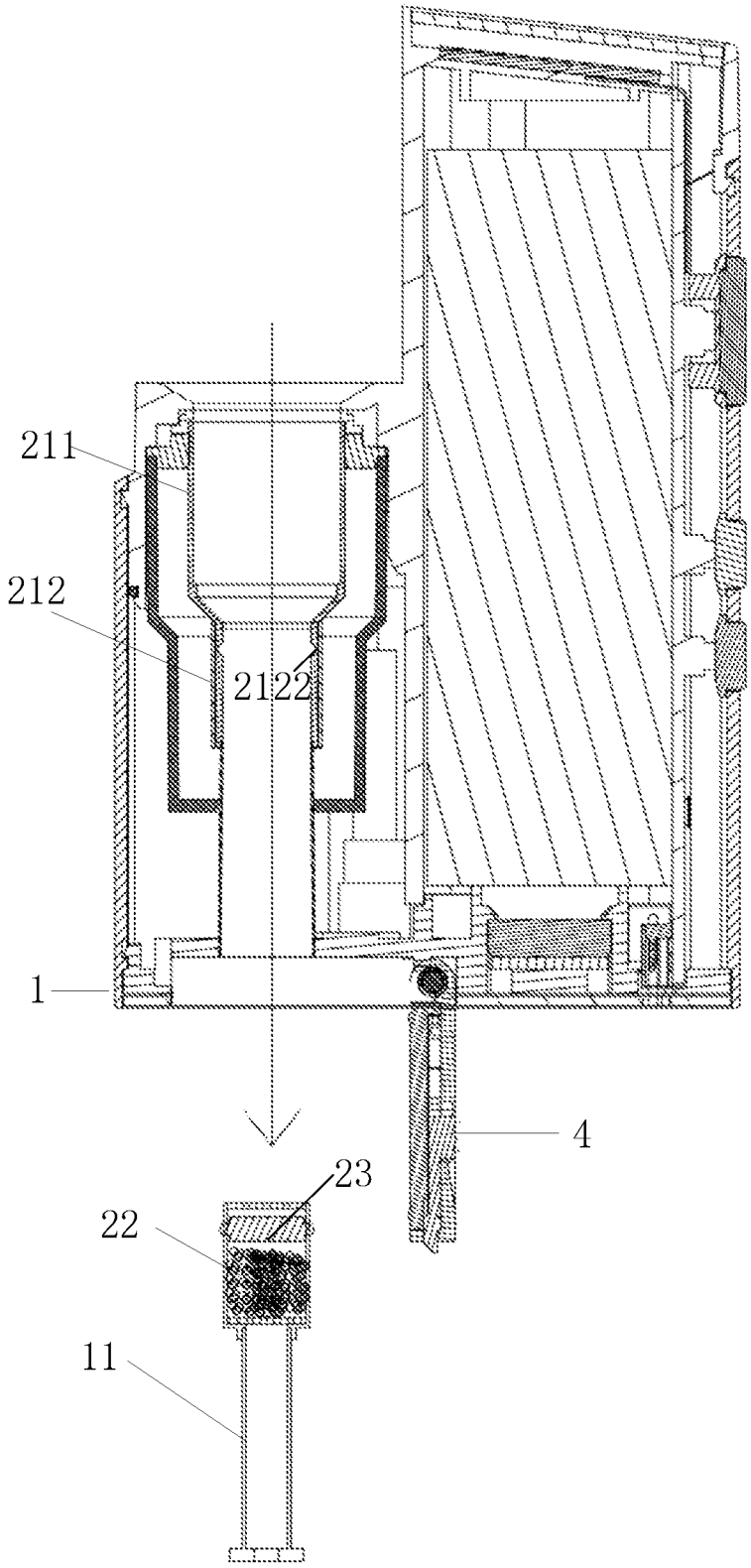
FIG. 5 is a cross-sectional view of the tobacco evaporator provided in the second embodiment of the present application during cleaning.

In combination with FIG. 5, when the tobacco evaporator needs to be cleaned, rotate the flip cover 4 to the position in the figure, the elastically stretchable bosses at both ends of the clamping portion 23 contract under the action of external force, the preheating assembly 22 is separated from the second bowl body 212, and the preheating assembly 22 is taken out from the second bowl body 212 away from the first bowl body 211 to the outside of the body 1 by pulling the vent pipe 11. After cleaning, push the preheating assembly 22 back into the second bowl body 212, and the elastically stretchable bosses at both ends of the clamping portion 23 move along the side wall of the second bowl body 212. When moving to the second groove 2122, the elastically stretchable bosses at both ends of the clamping portion 23 are inserted into the side wall of the second groove 2122 and butted with the side wall of the second groove 2122. As can be seen from FIG. 5, one end of the vent pipe 11 close to the flip cover 4 is a hollow handle to facilitate the removal of the preheating assembly 22, and in this embodiment the preheating assembly 22 is taken out from one side of the flip cover.

The Third Embodiment

The difference between this embodiment and the first two embodiments is that the position of the preheating assembly 22 and the structure of the smoke bowl assembly 21 are different. Specifically, as shown in FIG. 6, the second bowl body 212 is sleeved around the first bowl body 211, the first bowl body 211 is used to contain the material to be evaporated and the preheating assembly 22, and the first bowl body 211 and the second bowl body 212 can be elastically connected.

Further, one end of the second bowl body 212 away from the suction nozzle 2 butts with the vent pipe 11, the other end of the vent pipe 11 butts with the body 1; the clamping portion 23 is placed laterally inside the first bowl body 211, and the clamping portion 23 passes through the first bowl body 211 and butts with the second bowl body 212. When cleaning is required, the clamping portion 23 and the first bowl body 211 are taken out from the second bowl body 212. After cleaning, push the clamping portion 23 and the first bowl body 211 into the fastening position, and hold the clamping portion 23 against the second bowl body 212 to realize the fastening connection between the first bowl body 211 and the second bowl body 212.

Figure 6:
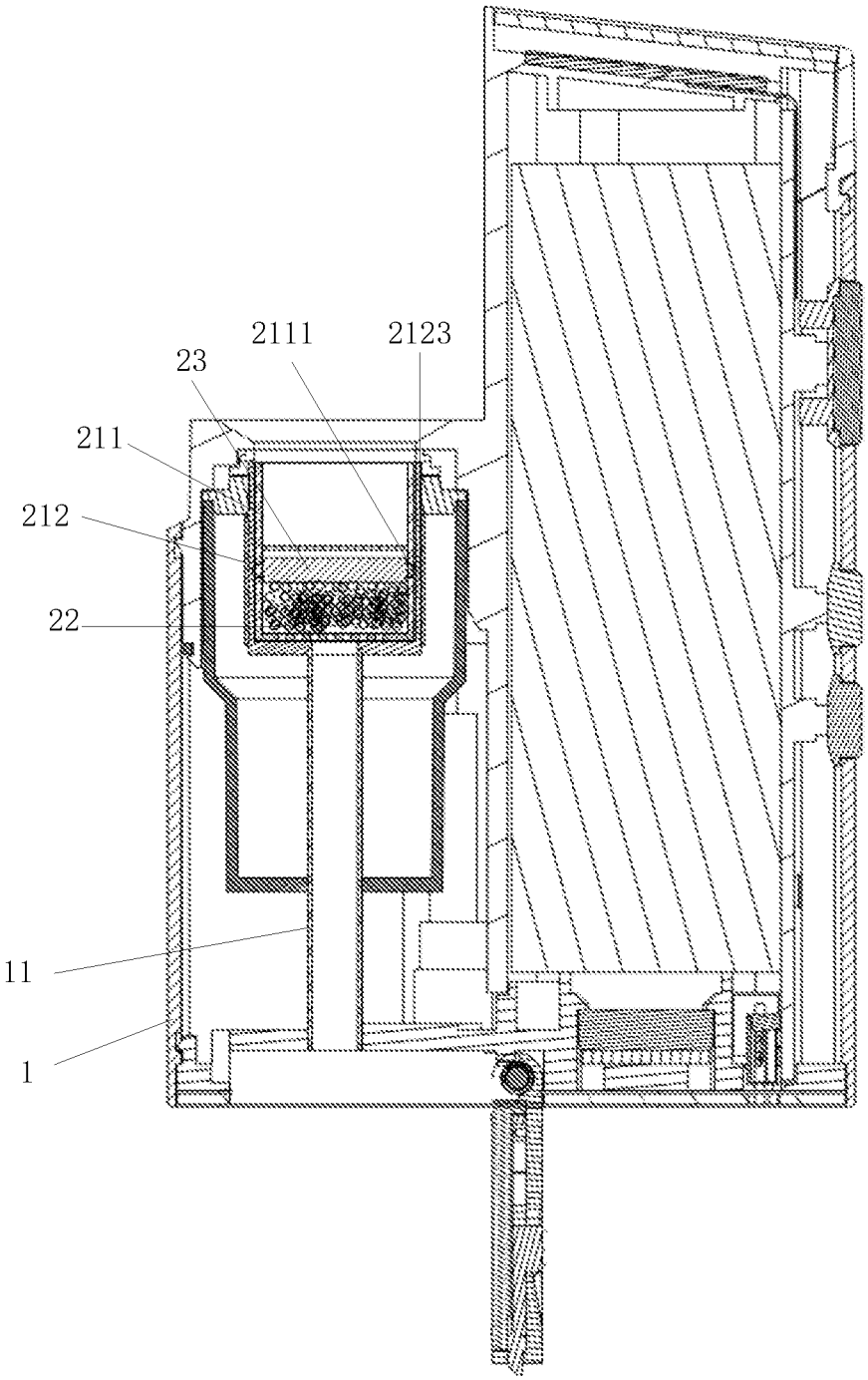
FIG. 6 is a cross-sectional view of a tobacco evaporator provided in the third embodiment of the present application.

Further, it can be seen from FIG. 6: both ends of the clamping portion 23 are provided with elastically stretchable bosses; the first bowl body 211 is provided with two fourth openings 2111 near the middle, the second bowl body 212 is provided with two third grooves 2123 at a position corresponding to the two fourth openings 2111; the elastically stretchable bosses on both ends of the clamping portion 23 penetrate the fourth opening 2111, and is inserted into a side wall of the second bowl body 212, and abuts against a side wall of the third groove 2123 to make the preheating assembly 22 elastically fastened to the second bowl body 212.

When cleaning is required, the elastically stretchable bosses on both ends of the clamping portion 23 contract under the action of external force, the first bowl body 211 is separated from the second bowl body 212, the first bowl body 211 is taken out to the outside of the body 1; after cleaning, the first bowl body 211 is pushed back to the inside of the second bowl body 212, and the elastically stretchable bosses on both ends of the clamping portion 23 move along the side wall of the second bowl body 212. When moving to the third groove 2123, the elastically stretchable bosses on both ends of the clamping portion 23 are inserted into the side wall of the third groove 2123 and butted with the side wall of the third groove 2123.

Figure 7:
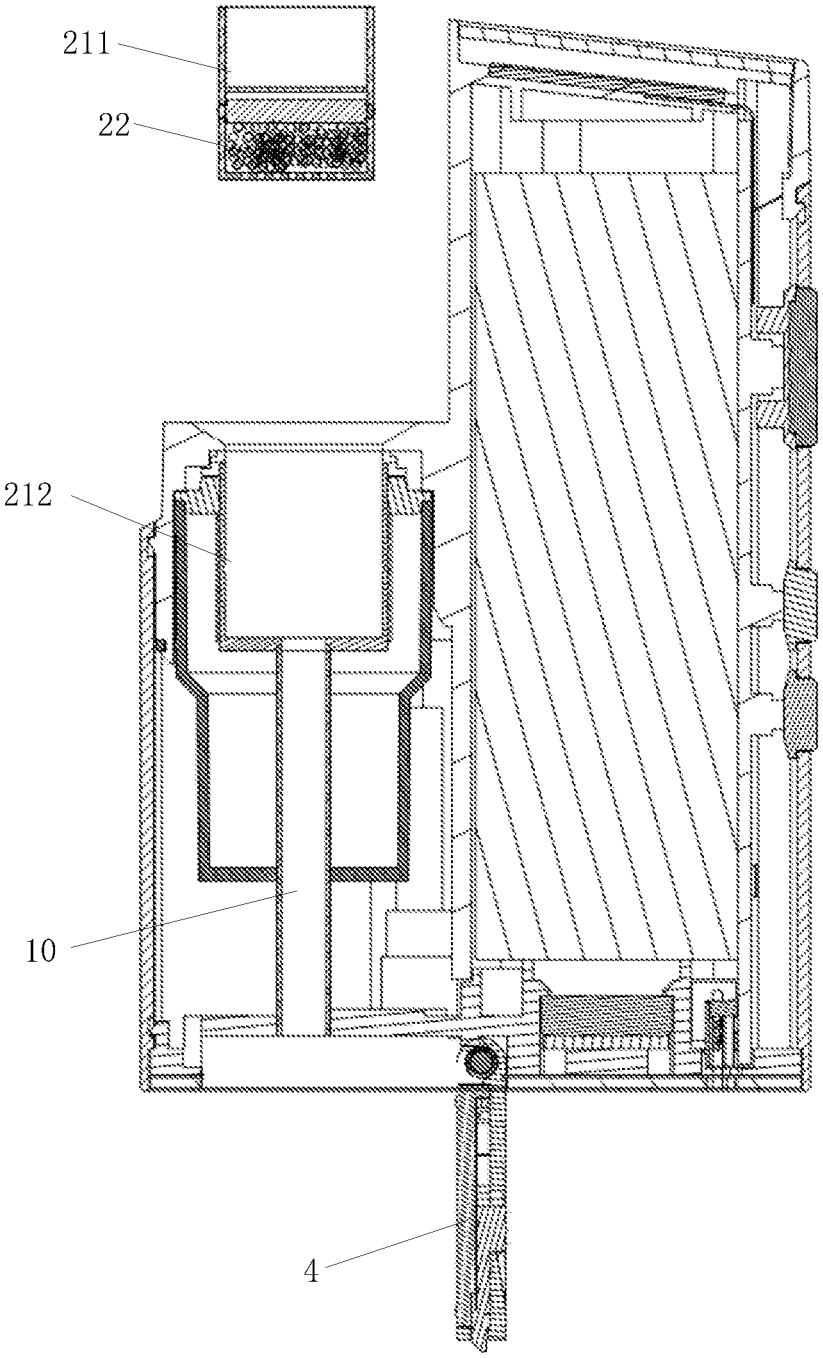
FIG. 7 is a cross-sectional view of the tobacco evaporator provided in the third embodiment of the present application during cleaning.

Referring to FIG. 7, when the tobacco evaporator is cleaned, take out the first bowl body 211 containing the substance to be evaporated and the preheating assembly 22 from the second bowl body 212, and rotate the flip cover 4 to the position shown in the figure, the smoke circulation channel 10 of the tobacco evaporator has no dead corner and is convenient for cleaning.

The Fourth Embodiment

Figure 8:
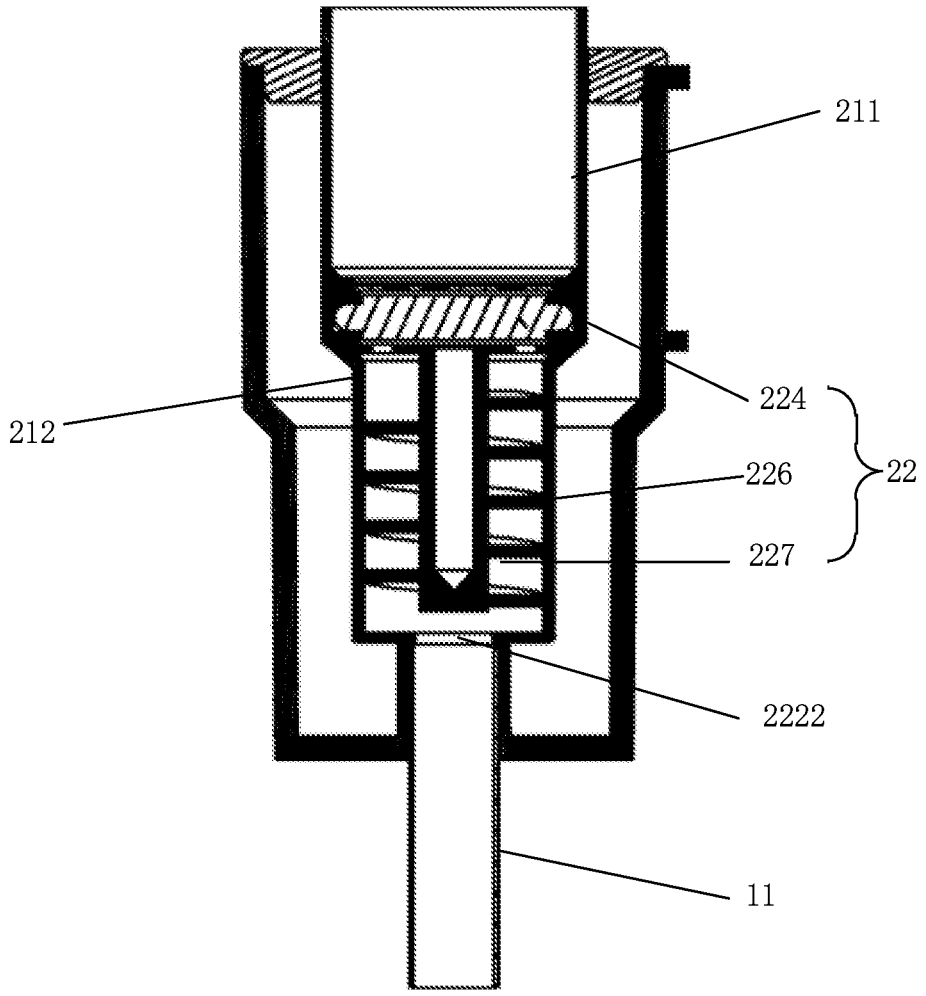
FIG. 8 is a cross-sectional view of a heating core assembly provided in the fourth embodiment of the present application.
Figure 9:
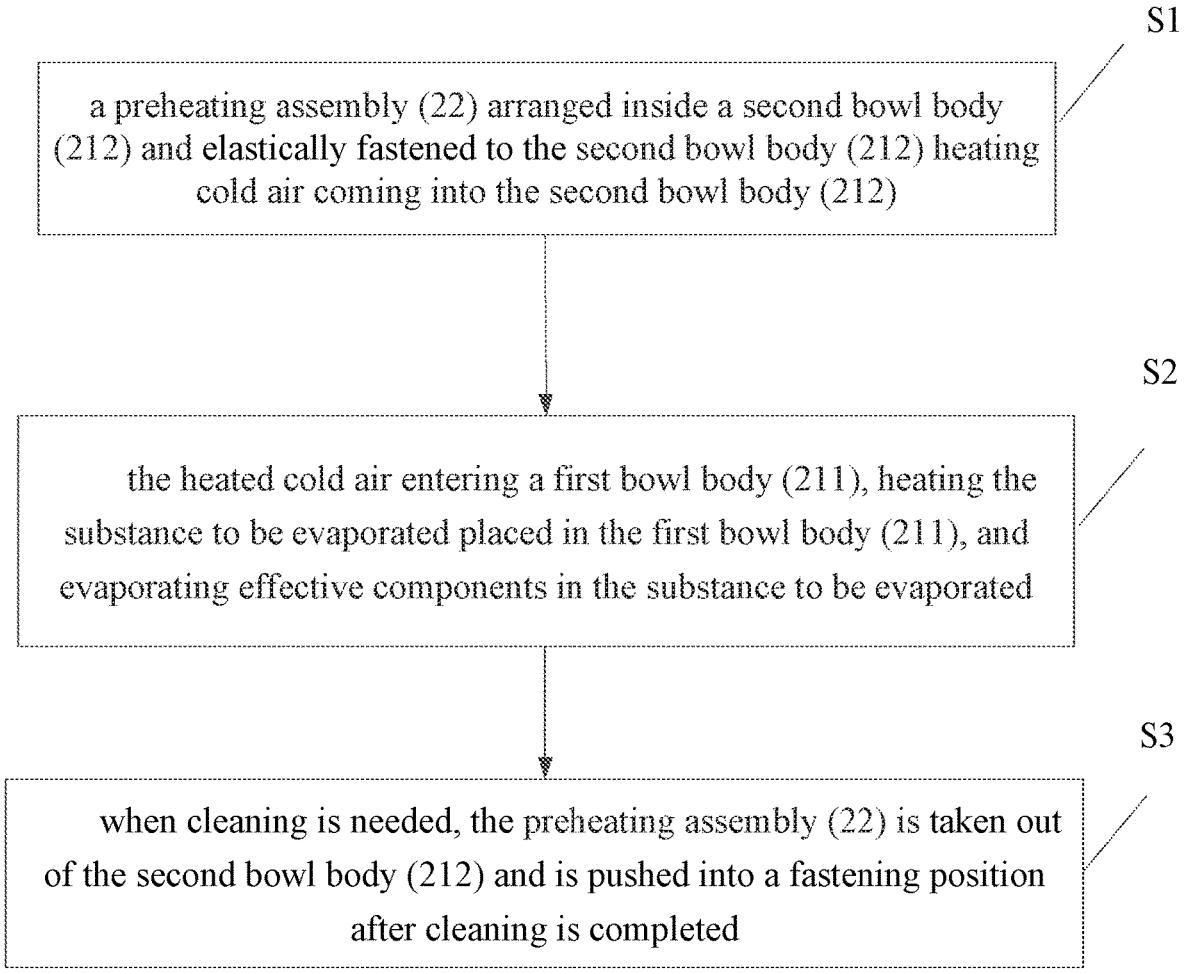
FIG. 9 is a flowchart of a tobacco heating control method provided in the fifth embodiment of the present application.

The difference between this embodiment and the above embodiment is that the structure of the preheating assembly 22 of this embodiment is different from that of the above embodiment. Specifically, it can be seen from FIG. 8: the preheating assembly 22 comprises a preheating assembly housing 224, a spiral part 227 placed under the preheating assembly housing 224 and abutted against the preheating assembly housing 224, and a heating element 226 sleeved outside the second bowl body 212; the bottom wall of the preheating assembly housing 224 close to the vent pipe 11 is provided with an air hole 2222 adapted to the vent pipe 11 for cold air entry; the heating element 226 used for heating cold air contacts with an outer wall of the second bowl body 212 and wraps the whole second bowl body 212; an outer wall of the spiral part 227 is contacted with an inner wall of the second bowl body 212; the outer wall of the spiral part 227 and the inner wall of the second bowl body 212 form a spiral preheating channel through which the cold air passes to realize the uniform heating of the cold air. Compared with the preheating assembly 22 in the first embodiment, the advantage of this embodiment is that the spiral part 227 in this embodiment is in direct contact with the second bowl body 212; the heat transfer medium passes from the heating element 226 to the cold air is less, the heat transfer efficiency is higher, and the cold air is more uniformly heated.

The Fifth Embodiment

The application further tobacco provides a heating control method comprising the following steps:

S1. a preheating assembly 22 arranged inside a second bowl body 212 and elastically fastened to the second bowl body 212 heating cold air coming into the second bowl body 212. Specifically, the preheating assembly 22 includes thermal conductive materials 225 and a heating element 226 sleeved outside the second bowl body 212. The heating element 226 is in contact with the outer wall of the second bowl body 212 for transferring the heat generated by the heating element 226 to the thermal conductive materials 225 through the second bowl body 212 to heat the thermal conductive materials 225. The heated thermal conductive materials 225 exchange heat with the cold air entering the preheating assembly 22 to realize that the cold air is heated, wherein the heating element 226 is a heating wire or an electric heating film.

S2. the heated cold air entering a first bowl body 211, heating the substance to be evaporated placed in the first bowl body 211, and evaporating effective components in the substance to be evaporated. The first bowl body 211 is provided with a mesh filter structure 2112 to prevent the material to be evaporated from falling, and a plurality of filter holes are distributed on the mesh filter layer structure 2112. At the same time, a plurality of filter holes can realize the uniform heating of the material to be evaporated and improve the evaporation efficiency of the material to be evaporated.

S3. when cleaning is needed, the preheating assembly 22 is taken out of the second bowl body 212 and is pushed into a fastening position after cleaning is completed. Specifically, after the preheating assembly 22 is taken out from the second bowl body 212, a hollow channel without dead corner is formed in the smoke circulation channel 10 of the tobacco evaporator to facilitate cleaning.

By designing the air preheating assembly as a detachable component, the user can disassemble the preheating assembly for cleaning; after the preheating assembly is removed from the body, the whole air passage forms a hollow passage through the front and back, without cleaning dead corner, which is convenient for cleaning; at the same time, as a detachable part, the preheating assembly can be replaced with a new one when it is used for a long time, so as to keep the air flow channel clean and the flue gas clean.

Although preferred embodiments of the present application have been described, those skilled in the art may make additional changes and modifications to these embodiments once they know the basic inventive concept. Therefore, the appended claims are intended to be interpreted as including preferred embodiments and all changes and modifications falling within the scope of the present application.

Obviously, those skilled in the art can make various changes and modifications to the application without departing from the spirit and scope of the application. Thus, if these modifications and variants of the application fall within the scope of the claims of the application and its equivalent technology, the application is also intended to include these modifications and variants.

What is claimed is:

1. A tobacco evaporator, comprising a body (1), a smoke circulation channel (10) vertically communicated along the body (1), and a heating core assembly (20) disposed on the path of the smoke circulation channel (10), wherein, the heating core assembly (20) comprises a smoke bowl assembly (21) and a preheating assembly (22) connected to the smoke bowl assembly (21); the smoke bowl assembly (21) comprises a first bowl body (211) and a second bowl body (212), and the first bowl body (211) and the second bowl body (212) are of an up-down structure or an inner and outer sleeving structure; the second bowl body (212) is elastically fastened to the preheating assembly (22), and the preheating assembly (22) is used for when cleaning is needed, being detachably taken out of the second bowl body (212) to clean the smoke circulation channel (10) and pushing the preheating assembly (22) into the fastening position in a set direction after cleaning is completed.

2. The tobacco evaporator according to claim 1, wherein, the first bowl body (211) is used for accommodating a substance to be evaporated, the second bowl body (212) is used for accommodating the preheating assembly (22); the heating core assembly (20) further comprises a clamping portion (23) transversely arranged in the second bowl body (212), the preheating assembly (22) is elastically fastened to the second bowl body (212) through the clamping portion (23).

3. The tobacco evaporator according to claim 2, wherein, the tobacco evaporator further comprises a suction nozzle (2) arranged at one end of the body (1) and a vent pipe (11) arranged at another end of the body (1), the first bowl body (211) and the second bowl body (212) are in an integrated structure; the second bowl body (212) extends with a reduced diameter in a direction away from the first bowl body (211) and abuts against the vent pipe (11), the clamping portion(23) is transversely arranged in the second bowl body (212), penetrates the preheating assembly (22), and abuts against the second bowl body (212) to make the preheating assembly (22) elastically fastened to the second bowl body (212); when cleaning is needed, the preheating assembly (22) is detachably taken out of the second bowl body (212) and is pushed into the fastening position after cleaning is completed.

4. The tobacco evaporator according to claim 3, wherein, both ends of the clamping portion(23) are provided with elastically stretchable bosses, the preheating assembly (22) is provided with two first openings (221) near an inner diameter of the second bowl body (212) with an abrupt change, the second bowl body (212) is provided with two first grooves (2121) at a position corresponding to the two first openings (221); the elastically stretchable bosses on both ends of the clamping portion (23) penetrate the first opening (221), and is inserted into the second bowl body (212), and abuts against a side wall of the first groove (2121) to make the preheating assembly (22) elastically fastened to the second bowl body (212).

5. The tobacco evaporator according to claim 2, wherein, the tobacco evaporator further comprises a vent pipe (11) and a support tube (12) arranged on the other end of the body (1), the first bowl body (211) an d the second bowl body (212) are in an integrated structure; the second bowl body (212) extends with a reduced diameter in a direction away from the first bowl body (211); one end of the support tube (12) abuts against the body (1), the other end of the support tube (12) extends to the second bowl body (212) and abuts against a bottom of the second bowl body (212); one end of the vent pipe (11) abuts against the body (1), the other end of the vent pipe (11) extends to the preheating assembly (22) and is fixedly connected with a bottom of the preheating assembly (22); the clamping portion(23) is transversely arranged in the second bowl body (212), penetrates the preheating assembly (22), and abuts against the second bowl body (212) to make the preheating assembly (22) elastically fastened to the second bowl body (212); when cleaning is needed, the preheating assembly (22) is taken out of the second bowl body (212) and is pushed into the fastening position after cleaning is completed.

6. The tobacco evaporator according to claim 5, wherein, both ends of the clamping portion (23) are provided with elastically stretchable bosses, the preheating assembly (22) is provided with two second openings (222) near an inner diameter of the second bowl body (212) with an abrupt change, the second bowl body (212) is provided with two second grooves (2122) at a position corresponding to the two second openings (222); the elastically stretchable bosses on both ends of the clamping portion (23) penetrate the second opening (222), and is inserted into the second bowl body (212), and abuts against a side wall of the second groove (2122) to make the preheating assembly (22) elastically fastened to the second bowl body (212).

7. The tobacco evaporator according to claim 2, wherein, the preheating assembly (22) comprises a preheating assembly housing (224), thermal conductive materials (225) placed inside the preheating assembly housing (224) and a heating element (226) sleeved outside the second bowl body (212), an outer wall of the preheating assembly housing (224) is contacted with an inner wall of the second bowl body (212); the heating element (226) contacted with an outer wall of the second bowl body (212) is used for heating the thermal conductive materials (225).

8. The tobacco evaporator according to claim 7, wherein, the tobacco evaporator further comprises a heat insulation (30) for insulating the preheating assembly (22) when the heating element (226) generates heat, the heat insulation (30) comprises an insulation ring (31) sleeved at an upper end of the first bowl body (211), an insulation sleeve (32) arranged outside the second bowl body (212) and a sealing silica gel (33) connecting the insulation ring (31) and the insulation sleeve (32); one end of the insulation sleeve (32) is connected with the sealing silica gel (33), the other end of the insulation sleeve (32) is bent to the vent pipe (11); the heat insulation (30) forms a closed thermal insulation space with the smoke bowl assembly (21) and the vent pipe (11), and the thermal insulation space is filled with thermal insulation materials to insulate the tobacco evaporator.

9. The tobacco evaporator according to claim 2, wherein, the preheating assembly (22) comprises a preheating assembly housing (224), a spiral part (227) placed under the preheating assembly housing (224) and abutted against the preheating assembly housing (224), and a heating element (226) sleeved outside the second bowl body (212); an outer wall of the spiral part (227) is contacted with an inner wall of the second bowl body (212); the heating element (226) contacted with an outer wall of the second bowl body (212) is used for heating cold air; the outer wall of the spiral part (227) and the inner wall of the second bowl body (212) form a spiral preheating channel through which the cold air passes to realize the uniform heating of the cold air.

10. The tobacco evaporator according to claim 1, wherein, the tobacco evaporator further comprises a suction nozzle (2) arranged at one end of the body (1) and a vent pipe (11) arranged at another end of the body (1), the second bowl body (212) is sleeved on an outer periphery of the first bowl body (211); the first bowl body (211) is elastically fastened with the second bowl body (212), the first bowl body (211) is used for accommodating a substance to be evaporated and the preheating assembly (22); the heating core assembly (20) comprises a clamping portion (23) transversely arranged in the second bowl body (212), the preheating assembly (22) is elastically fastened with second bowl body (212) through the clamping portion(23); the clamping portion(23) penetrates and accommodates the preheating assembly (22) and the first bowl body (211), and abuts against the second bowl body (212); when cleaning is needed, the preheating assembly (22) is taken out of the second bowl body (212) and is pushed into the fastening position after cleaning is completed.

11. The tobacco evaporator according to claim 10, wherein, both ends of the clamping portion(23) are provided with elastically stretchable bosses, the first bowl body (211) is provided with two fifth openings (2111), the second bowl body (212) is provided with two third grooves (2123) at a position corresponding to the two fifth openings (2111); the elastically stretchable bosses on both ends of the clamping portion (23) penetrate the fifth opening (2111), and is inserted into a side wall of the second bowl body (212), and abuts against a side wall of the third groove (2123) to make the preheating assembly (22) elastically fastened to the second bowl body (212).

12. The tobacco evaporator according to claim 1, wherein, the tobacco evaporator further comprises a flip cover (4) rotatably connected to the body (1), a rotating shaft (13) is arranged on a bottom of the body (1), and one end of the flip cover (4) is provided with a hole (41) matched with a clearance of the rotating shaft (13), so that the flip cover (4) can be turned along the rotating shaft (13).

* * * * *